US011752654B2

(12) United States Patent
Haller

(10) Patent No.: US 11,752,654 B2
(45) Date of Patent: Sep. 12, 2023

(54) AUXILIARY SAW FENCES

(71) Applicant: Blaise Haller, Vancouver, WA (US)

(72) Inventor: Blaise Haller, Vancouver, WA (US)

( * ) Notice: Subject to any disclaimer, the term of this patent is extended or adjusted under 35 U.S.C. 154(b) by 0 days.

(21) Appl. No.: 17/334,530

(22) Filed: May 28, 2021

(65) Prior Publication Data

US 2021/0283798 A1 Sep. 16, 2021

(51) Int. Cl.
*B27B 27/08* (2006.01)

(52) U.S. Cl.
CPC ..... *B27B 27/08* (2013.01)

(58) Field of Classification Search
CPC ..... B27B 27/08; B27B 27/10; B27B 27/06; B27B 5/29; B27B 27/02; B27B 27/04; B23D 45/048; B23D 47/025; B23D 45/46; B23D 45/044; B23D 59/005
USPC ..... 83/468.7, 471.3, 490, 581, 448, 491.2, 83/468.3, 397, 478, 391, 393; 144/287
See application file for complete search history.

(56) References Cited

U.S. PATENT DOCUMENTS 1,259,380 A 3/1918 Eagleson
5,297,463 A * 3/1994 O'Banion ..... B27B 27/04 83/490
9,302,408 B2 * 4/2016 Smith ..... E04F 21/0069
2002/0100350 A1 * 8/2002 Brazell ..... B27B 27/08 83/438
2008/0053283 A1 * 3/2008 Lin ..... B27B 27/08 83/440
2009/0235797 A1 * 9/2009 Kani ..... B23D 47/04 83/477

FOREIGN PATENT DOCUMENTS

EP 752300 A1 * 1/1997 ..... B27B 27/00
EP 0752300 A1 1/1997

* cited by examiner

*Primary Examiner* — Ghassem Alie
(74) *Attorney, Agent, or Firm* — Mohr Intellectual Property Law Solutions, P.C.

(57) ABSTRACT

Auxiliary fences for a saw that includes a saw blade and a primary fence. The auxiliary fence includes a fixed plate and a moveable plate. The fixed plate is removably coupled to the primary fence. The moveable plate is moveably coupled to the fixed plate. The moveable plate extends between a trailing end and a leading end longitudinally opposite the trailing end. The leading end is disposed proximate a cutting path of the saw. The trailing end is disposed distal the cutting path. The moveable plate is configured to move to selectively adjust the spacing between the leading end and the cutting path.

17 Claims, 5 Drawing Sheets

AUXILIARY SAW FENCES

BACKGROUND

The present disclosure relates generally to saw fences. In particular, auxiliary saw fences are described.

Fences are commonly used with different types of saws to support workpieces being cut by the saw. A fence on a miter saw, for example, supports a workpiece transverse to a saw blade as the saw blade cuts the workpiece to a desired angle and length. This application will focus on fences for miter saws and will simply refer to these items as fences and saws for brevity.

Known fences are not entirely satisfactory for the range of applications in which they are employed. For example, existing fences have a wide gap near the saw blade. The wide gap creates a safety hazard and reduces cut accuracy.

Conventional fences create a safety hazard in multiple respects. For example, the wide gap can result in fragments of the workpiece being ejected at high speed away from the saw blade and flying freely. The free-flying fragments can injure the user of the saw or damage nearby objects.

Attempting to cut small workpieces with a conventional fence is another source of potential danger. A wide fence gap near a saw blade when cutting a narrow workpiece results in a relatively large percent of the workpiece being unsupported by the fence. The reduced support can cause the workpiece to be violently pulled or jerked by the saw blade. Enhancing the danger is the fact that a user's fingers holding the workpiece against a conventional fence are close to the saw blade on account of the workpiece being narrow. The proximity of the user's fingers and the tendency for poorly supported workpieces to be pulled towards the spinning blade creates a significant risk of seriously injuring the user by his or her fingers getting sucked into the cutting blade.

The wide gap of conventional fences can reduce the accuracy of cuts by poorly supporting workpieces near the saw blade. This problem is exacerbated when cutting narrow workpieces since the gap of conventional fences leaves a substantial portion of the workpiece unsupported. Insufficiently supported workpieces tend to jostle and shift when cut by the saw blade, which moves them out of position and reduces the accuracy of the cut.

Thus, there exists a need for improvements to existing fences that address the shortcomings of conventional fences. Examples of new and useful auxiliary fences addressing the needs existing in the field are discussed below.

SUMMARY

The present disclosure is directed to auxiliary fences for a saw including a saw blade and a primary fence. The auxiliary fence includes a fixed plate and a moveable plate. The fixed plate is removably coupled to the primary fence. The moveable plate is moveably coupled to the fixed plate. The moveable plate extends between a trailing end and a leading end longitudinally opposite the trailing end. The leading end is disposed proximate a cutting path of the saw. The trailing end is disposed distal the cutting path. The moveable plate is configured to move to selectively adjust the spacing between the leading end and the cutting path.

DETAILED DESCRIPTION

Figure 1:
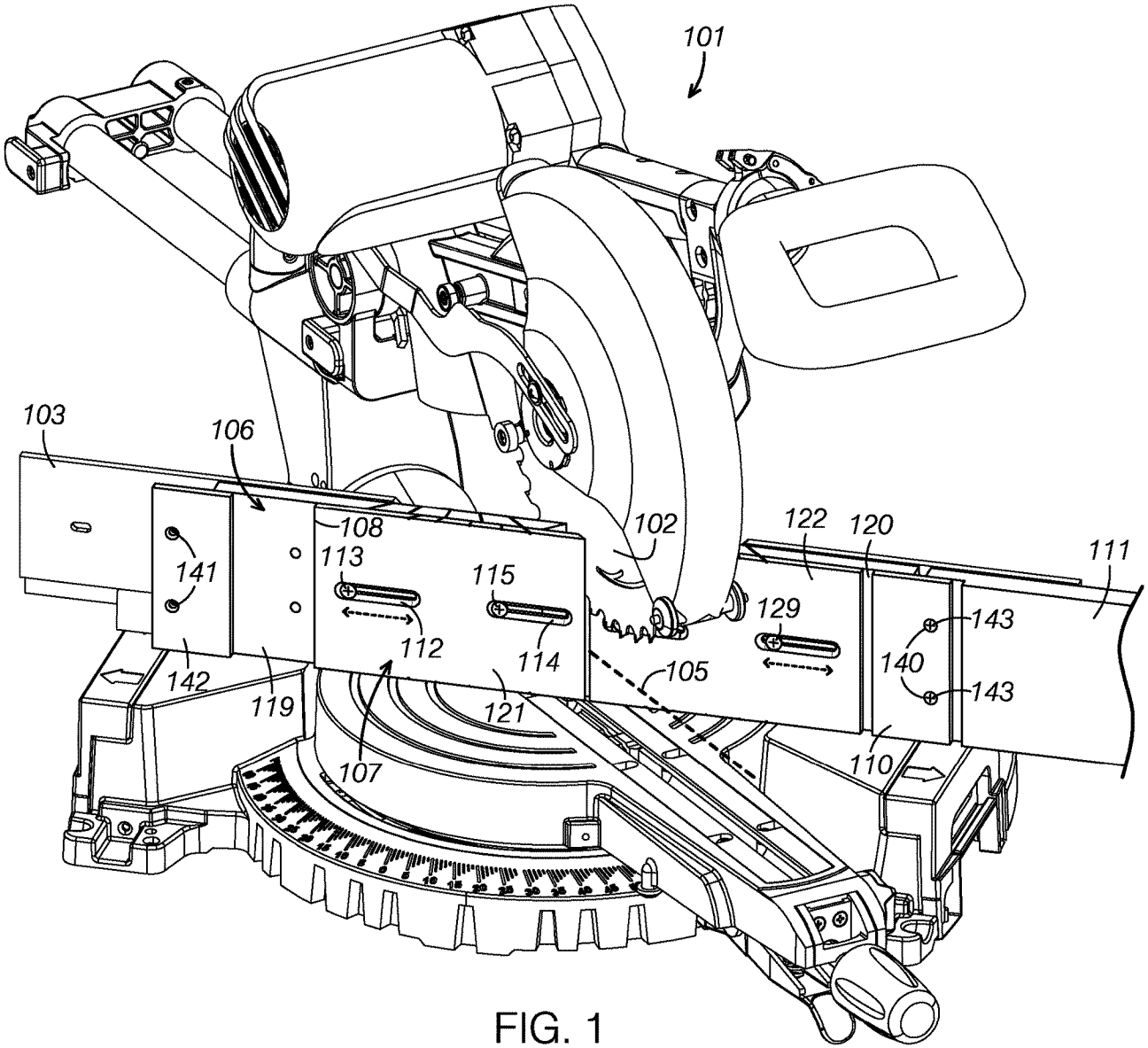
FIG. 1 is a perspective view of a first embodiment of an auxiliary fence for a saw.

The disclosed auxiliary fences will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various auxiliary fences are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Auxiliary Saw Fences

With reference to the figures, auxiliary saw fences will now be described. The auxiliary fences discussed herein function to support workpieces being cut by a saw. The auxiliary fences discussed below further function to support fence extensions to enable longer workpieces to be supported.

The reader will appreciate from the figures and description below that the presently disclosed auxiliary fences address many of the shortcomings of conventional fences. For example, the auxiliary fences disclosed herein reduce the effective gap near the saw blade to address the problems associated with the wide gaps that result from conventional fences. As a result, the auxiliary fences significantly reduce the safety hazards of conventional fences. The auxiliary fences also significantly increase the cut accuracy that would otherwise not be possible with conventional fences.

The auxiliary fences discussed below improve safety by guarding against workpiece fragments ejecting at high speed away from the saw blade. Reducing or eliminating free-flying fragments reduces the potential for such fragments to injure the user of the saw or to damage nearby objects.

Another improvement over conventional fences is that the auxiliary fences described herein make cutting narrow workpieces safer. Reducing the effective gap near a saw blade when cutting a narrow workpiece increases the percentage of the workpiece that is supported. Increasing how much of the workpiece is supported reduces the risk of the saw blade violently pulling or jerking the workpiece. Avoiding the workpiece being pulled or jerked by the saw blade reduces the risk of the user's fingers getting sucked into the cutting blade.

The auxiliary fences discussed below also improve the accuracy of cuts by better supporting workpieces near the saw blade. This improvement is especially apparent when cutting narrow workpieces since the gap of conventional fences leaves a substantial portion of the workpiece unsupported. The presently disclosed auxiliary fences support narrow workpieces sufficiently to significantly reduce or eliminate the workpieces jostling and shifting when cut by the saw blade. Thus, the auxiliary fences described herein help maintain the workpieces in a desired position to improve the accuracy of the cut.

Contextual Details

Ancillary features relevant to the auxiliary fences described herein will first be described to provide context and to aid the discussion of the auxiliary fences.

Saw

The auxiliary fence examples discussed in this application are configured to be used with a saw. As one example of a saw, FIG. 1 depicts auxiliary fence 100 being used with a miter saw 101. As shown in FIG. 1, saw 101 includes a saw blade 102 and a primary fence 103.

The saw may be any currently known or later developed type of saw. The reader will appreciate that a variety of saw types exist and could be used in place of the saw shown in the figures. In addition to the types of saws existing currently, it is contemplated that the auxiliary fences described herein could be used with new types of saws developed in the future.

The size of the saw may be varied as needed for a given application. In some examples, the saw is larger relative to the other components than depicted in the figures. In other examples, the saw is smaller relative to the other components than depicted in the figures. Further, the reader should understand that the saw and the other components may all be larger or smaller than described herein while maintaining their relative proportions.

Saw Blade

The reader can see in FIG. 1 that saw blade 102 is configured to cut a workpiece along a cutting path 105. With reference to FIG. 1, saw 101 is configured to pivot saw blade 102 to define cutting paths oriented at different angles relative to primary fence 103.

The saw blade may be any currently known or later developed type of saw blade. The reader will appreciate that a variety of saw blade types exist and could be used in place of the saw blade shown in the figures. In addition to the types of saw blades existing currently, it is contemplated that the auxiliary fences described herein could be used with new types of saw blades developed in the future.

The size of the saw blade may be varied as needed for a given application. In some examples, the saw blade is larger relative to the other components than depicted in the figures. In other examples, the saw blade is smaller relative to the other components than depicted in the figures. Further, the reader should understand that the saw blade and the other components may all be larger or smaller than described herein while maintaining their relative proportions.

Primary Fence

Primary fence 103 functions to support a workpiece. In particular, primary fence 103 supports a workpiece in a position where the workpiece is disposed in cutting path 105 to be cut by saw blade 102. As shown in FIG. 1, primary fence 103 extends transverse to saw blade 102. The reader can see in FIG. 1 that primary fence 103 has a fixed width.

The primary fence may be any currently known or later developed type of saw fence. The reader will appreciate that a variety of saw fence types exist and could be used in place of the primary fence shown in the figures. In addition to the types of saw fences existing currently, it is contemplated that the auxiliary fences described herein could be used with new types of saw fences developed in the future.

The size of the primary fence may be varied as needed for a given application. In some examples, the primary fence is larger relative to the other components than depicted in the figures. In other examples, the primary fence is smaller relative to the other components than depicted in the figures. Further, the reader should understand that the primary fence and the other components may all be larger or smaller than described herein while maintaining their relative proportions.

Auxiliary Fence Embodiment 1

With reference to FIGS. 1-5, an auxiliary fence 100 will now be described as a first example of an auxiliary fence. As depicted in FIGS. 1-5, auxiliary fence 100 includes a fixed plate 106, a moveable plate 107, a first link plate 110, a second link plate 142, a first shaft 113, a second shaft 115, a third shaft (obscured by saw blade 102 in FIG. 1), and a fourth shaft 129. In other examples, the auxiliary fence includes fewer components than depicted in the figures. In certain examples, the auxiliary fence includes additional or alternative components than depicted in the figures.

Fixed Plate

Figure 5:
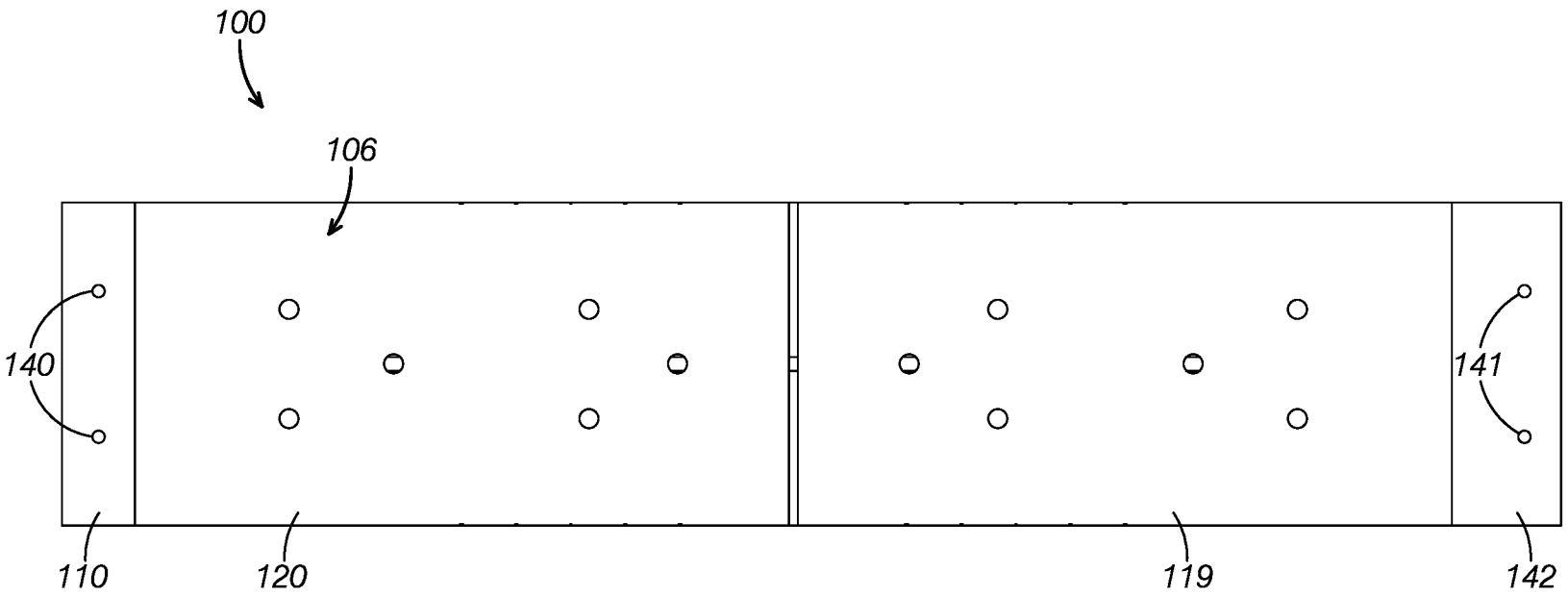
FIG. 5 is a rear elevation view of the auxiliary fence shown in FIG. 1.

The role of fixed plate 106 is to couple auxiliary fence 100 to primary fence 103 and to support moveable plate 107. With reference to FIGS. 1 and 5, fixed plate 106 is removably coupled to primary fence 103 by eight shafts that extend through the eight holes depicted in FIG. 5. In FIG. 5, the eight holes for coupling fixed plate 106 to primary fence 103 are arranged in four sets of vertically stacked pairs. In other examples, the fixed plate is fixedly coupled to the primary fence and/or removably coupled to the primary fence by other means, such as magnetic couplers, hook-and-loop fasteners, or mechanical fasteners, such as nails, screws, or rivets.

Figure 3:
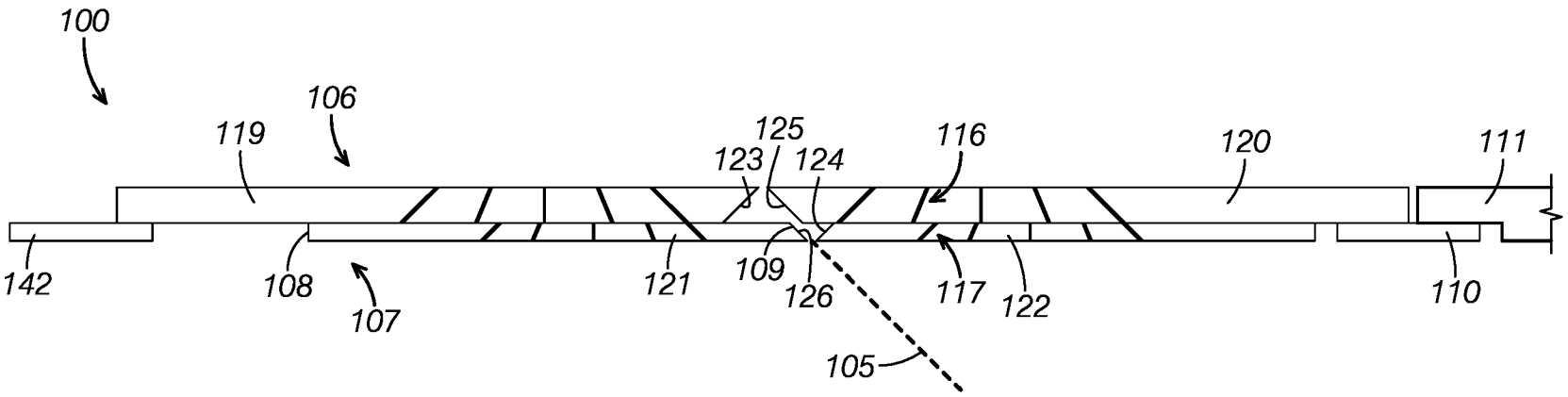
FIG. 3 is a top plan view of the auxiliary fence shown in FIG. 1.
Figure 4:
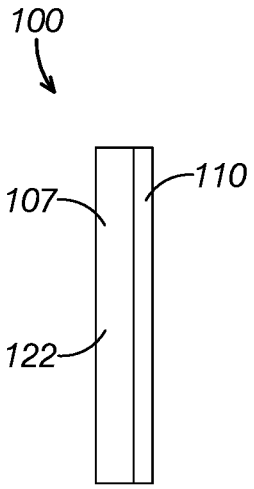
FIG. 4 is a left side elevation view of the auxiliary fence shown in FIG. 1

The reader can see in FIGS. 1, 3, and 5 that fixed plate 106 includes a first fixed portion 119 and a second fixed portion 120. As depicted in FIGS. 1, 3, and 5, first fixed portion 119 is spaced from second fixed portion 120 to enable saw blade 102 to pass between them. The gap between first fixed portion 119 and second fixed portion 120 is typically smaller than the gap between portions of primary fence 103, but need not be smaller in all examples.

As shown in FIG. 3, first fixed portion 119 defines a first beveled edge 123 proximate cutting path 105. The reader can see in FIG. 3 that second fixed portion 120 defines a second beveled edge 125 proximate cutting path 105. As depicted in FIG. 3, first beveled edge 123 and second beveled edge 125 are substantially perpendicular to each other. As further depicted in FIG. 3, to enable auxiliary plate to closely flank saw blade 102, first beveled edge 123 is substantially parallel to fourth beveled edge 124 of moveable plate 107 and second beveled edge 125 is substantially parallel to third beveled edge 126 of moveable plate 107.

The size of the fixed plate may be varied as needed for a given application. In some examples, the fixed plate is larger relative to the other components than depicted in the figures. In other examples, the fixed plate is smaller relative to the other components than depicted in the figures. Further, the reader should understand that the fixed plate and the other components may all be larger or smaller than described herein while maintaining their relative proportions.

In the present example, the fixed plate is composed of a phenolic sheet material. However, the fixed plate may be composed of any currently known or later developed material suitable for the applications described herein for which it is used. Suitable materials include metals, polymers, ceramics, wood, and composite materials.

Moveable Plate

Moveable plate 107 functions to move to different positions relative to fixed plate 106 to accommodate different cutting paths and to support the workpiece close to where saw blade 102 will extend along a selected cutting path. Moveable plate 107 also functions to shield the user and surroundings from workpiece fragments ejected by saw blade 102.

Figure 2:
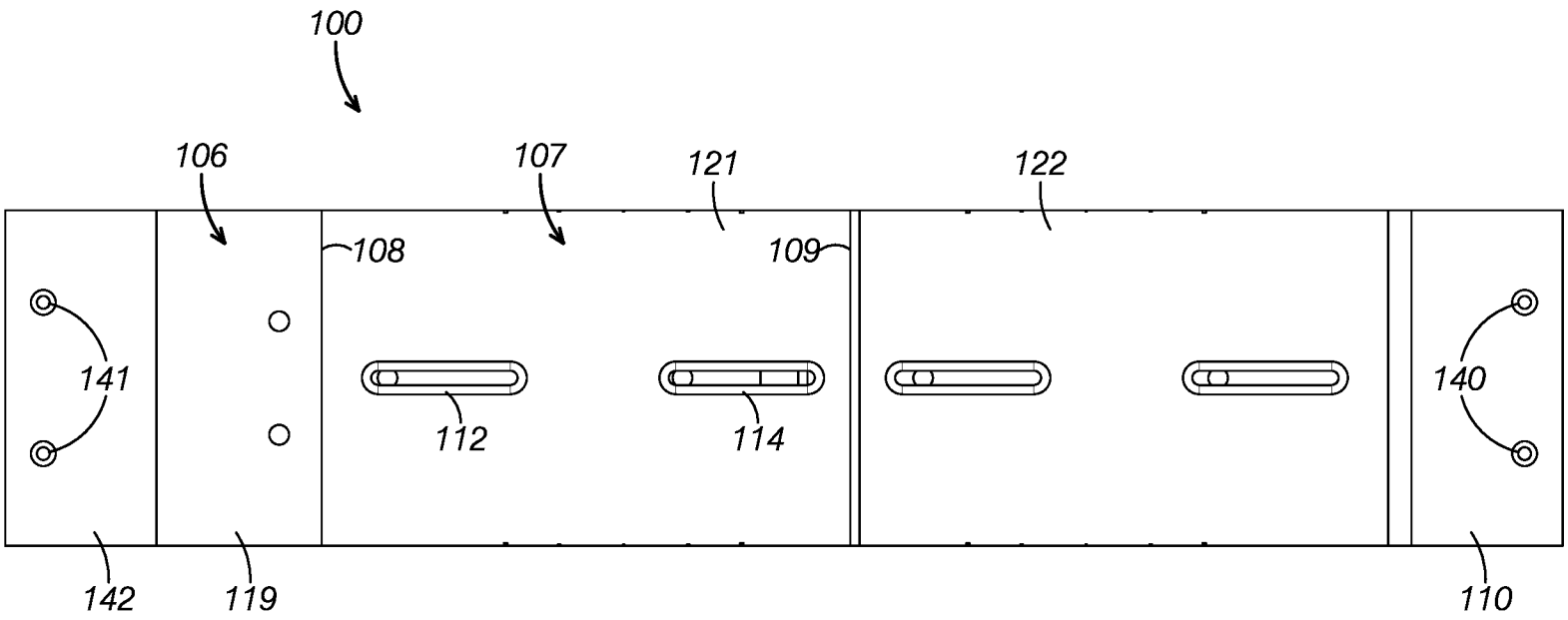
FIG. 2 is a front elevation view of the auxiliary fence shown in FIG. 1.

As depicted in FIGS. 1-3, moveable plate 107 is removably coupled to fixed plate 106. The reader can see in FIGS. 1-3 that moveable plate 107 includes a first moveable portion 121 and a second moveable portion 122. Second moveable portion 122 is configured similarly to first moveable portion 121. As depicted in FIGS. 1-3, first moveable portion 121 is moveably coupled to first fixed portion 119. As shown in FIGS. 1-3, second moveable portion 122 is spaced from first moveable portion 121 and moveably coupled to second fixed portion 120.

The reader can see in FIGS. 1-3 that first moveable portion 121 extends between a trailing end 108 and a leading end 109. Leading end 109 is longitudinally opposite trailing end 108. With reference to FIGS. 1-3, leading end 109 is disposed proximate cutting path 105. As shown in FIGS. 1-3, trailing end 108 is disposed distal cutting path 105.

As shown in FIG. 1 with a double-headed arrow and also in depicted generally in FIGS. 2 and 3, first moveable portion 121 is configured to move relative to first fixed portion 119 to selectively adjust the spacing between leading end 109 and cuffing path 105. In particular, first moveable portion 121 is configured to move to selectively adjust the spacing between leading end 109 and different cutting paths established by saw blade 102 pivoting to different angles relative to primary fence 103. As shown in FIG. 1 with a double-headed arrow, second moveable portion 122 is similarly configured to move to selectively adjust the spacing between its leading end and cutting path 105.

The reader can see in FIGS. 1-3 that moveable plate 107 is configured to selectively move to minimize the spacing between the leading ends of first moveable portion 121 and second moveable portion 122 proximate cutting path 105. Minimizing the spacing between the leading ends of first moveable portion 121 and second moveable portion 122 enables moveable plate 107 to block workpiece fragments ejected by saw blade 102 when a cutting workpiece.

As shown in FIGS. 1 and 2, first moveable portion 121 defines a first slot 112 extending longitudinally. The reader can see in FIG. 1 that first moveable portion 121 is vertically supported on first shaft 113 extending through first slot 112. The reader can see in FIGS. 1 and 2 that first slot 112 and first shaft 113 cooperate to define how far first moveable portion 121 may selectively move relative to first fixed portion 119.

With reference to FIGS. 1 and 2, first moveable portion 121 defines a second slot 114 extending longitudinally and longitudinally spaced from first slot 112. As depicted in FIGS. 1 and 2, second slot 114 is substantially identical to first slot 112. As shown in FIG. 1, first moveable portion 121 is also vertically supported on second shaft 115 extending through second slot 114.

The size of the slots may be varied as needed for a given application. In some examples, the slots are larger relative to the other components than depicted in the figures. In other examples, the slots are smaller relative to the other components than depicted in the figures. Further, the reader should understand that the slots and the other components may all be larger or smaller than described herein while maintaining their relative proportions.

As depicted in FIG. 3, first moveable portion 121 defines a third beveled edge 126 proximate cutting path 105. The reader can see in FIG. 3 that second moveable portion 122 defines a fourth beveled edge 124 proximate cutting path 105. With reference to FIG. 3, fourth beveled edge 124 is substantially parallel to first beveled edge 123. As shown in FIG. 3, third beveled edge 126 is substantially parallel to second beveled edge 125.

As depicted in FIGS. 1-3, first beveled edge 123 and fourth beveled edge 124 cooperate to closely flank cutting path 105 on opposite sides of cutting path 105 when first moveable portion 121 is selectively moved proximate cutting path 105. With reference to FIGS. 1-3, the close flanking position of moveable plate 107 is selected to reduce the gap between first beveled edge 123 and fourth beveled edge 124 through which saw blade 102 extends along cutting path 105 sufficient to block workpiece fragments ejected by saw blade 102 when cutting a workpiece. The reader can also see in FIGS. 1-3 that second beveled edge 125 and third beveled edge 126 cooperate to closely flank cutting path 105 on opposite sides of cutting path 105 when second moveable portion 122 is selectively moved proximate cutting path 105. As shown in FIGS. 1-3, moveable plate 107 is configured to closely flank different cutting paths oriented at different angles relative to primary fence 103 as saw 101 pivots saw blade 102 by positioning third beveled edge 126 and/or fourth beveled edge 124 proximate to the cutting paths.

In the present example, the moveable plate is composed of a phenolic sheet material. However, the moveable plate may be composed of any currently known or later developed material suitable for the applications described herein for which it is used. Suitable materials include metals, polymers, ceramics, wood, and composite materials.

The size of the moveable plate may be varied as needed for a given application. In some examples, the moveable plate is larger relative to the other components than depicted in the figures. In other examples, the moveable plate is smaller relative to the other components than depicted in the figures. Further, the reader should understand that the moveable plate and the other components may all be larger or smaller than described herein while maintaining their relative proportions.

Guide Marks

As shown in FIG. 3, fixed plate 106 defines a first set of guide marks 116 at selected angles. As shown in FIG. 3, moveable plate 107 defines a second set of guide marks 117 at selected angles corresponding to the selected angles of first set of guide marks 116. First set of guide marks 116 cooperate with second set of guide marks 117 to establish predetermined cutting paths.

As depicted in FIG. 3, aligning a selected guide mark from second set of guide marks 117 with a corresponding guide mark of first set of guide marks 116 positions moveable plate 107 at a desired position proximate cutting path 105. Aligning the selected guide marks also establishes a predetermined cutting path oriented at a predetermined angle relative to primary fence 103. For example, if a user wanted to cut a workpiece at a 45 degree angle, he or she could use the guide marks to quickly position moveable plate 107 to accommodate a 45 degree angle cut by aligning a guide mark on moveable plate 107 corresponding to a 45 degree angle with a guide mark on fixed plate 106 corresponding to a 45 degree angle.

The number of guide marks in the auxiliary fence may be selected to meet the needs of a given application. The reader should appreciate that the number of guide marks may be different in other examples than is shown in the figures. For instance, some auxiliary fence examples include additional or fewer guide marks than described in the present example.

The guide mark may be any currently known or later developed type of guide mark. The reader will appreciate that a variety of guide mark types exist and could be used in place of the guide mark shown in the figures. In addition to the types of guide marks existing currently, it is contemplated that the auxiliary fences described herein could incorporate new types of guide marks developed in the future.

Link Plates

The role of link plates 110 and 142 are to selectively couple extension member 111 to auxiliary fence 100. Fence extension member 111 serves to extend the length over which auxiliary fence 100 may support a workpiece. As depicted in FIGS. 1, 2, and 5, link plates 110 and 142 include mounting points 140 and 141 to cooperate with threaded fasteners 143 to couple with fence extension member 111. The reader can see in FIGS. 1-4 that link plates 110 and 142 are removably mounted to fixed plate 106.

The size of the link plates may be varied as needed for a given application. In some examples, the link plates are larger relative to the other components than depicted in the figures. In other examples, the link plates are smaller relative to the other components than depicted in the figures. Further, the reader should understand that the link plates and the other components may all be larger or smaller than described herein while maintaining their relative proportions.

In the present example, the link plates are composed of phenolic sheet material. However, the link plates may be composed of any currently known or later developed material suitable for the applications described herein for which it is used. Suitable materials include metals, polymers, ceramics, wood, and composite materials.

Shafts

The role of the shafts is to couple moveable plate 107 to fixed plate 106 and to moveably support moveable plate 107. The third shaft and fourth shaft 129 are configured the same as first shaft 113 and second shaft 115, respectively.

With reference to FIG. 1, first shaft 113 is coupled to fixed plate 106 and extends through first slot 112. As shown in FIG. 1, first shaft 113 is a threaded fastener. The reader can see in FIG. 1 that second shaft 115 is coupled to fixed plate 106 and extends through second slot 114.

The number of shafts in the auxiliary fence may be selected to meet the needs of a given application. The reader should appreciate that the number of shafts may be different in other examples than is shown in the figures. For instance, some auxiliary fence examples include additional or fewer shafts than described in the present example.

The shafts may be any currently known or later developed type of shaft. The reader will appreciate that a variety of shaft types exist and could be used in place of the shafts shown in the figures. In addition to the types of shafts existing currently, it is contemplated that the auxiliary fences described herein could incorporate new types of shafts developed in the future.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. An auxiliary fence for a saw having a saw blade and a primary fence, the saw blade being configured to cut a workpiece along a cutting path and the primary fence extending transverse to the saw blade and supporting the workpiece in a position where the workpiece is disposed in the cutting path to be cut by the saw blade, the auxiliary fence comprising:

a fixed plate removeably coupled to the primary fence, the fixed plate comprising:

a first fixed portion defines a first beveled edge proximate the cutting path; and a second fixed portion defines a second beveled edge proximate the cutting path, the second fixed portion configured to be spaced from the first fixed portion;

a moveable plate moveably coupled to the fixed plate, the moveable plate comprising:

a first moveable portion defines a third beveled edge proximate the cutting path, the first moveable portion configured to moveably couple to the first fixed portion; and a second moveable portion defines a fourth beveled edge proximate the cutting path, the second moveable portion configured to moveably couple to the second fixed portion and spaced from the first moveable portion, wherein the moveable plate extends between a trailing end and a leading end longitudinally opposite the trailing end;

wherein the leading end is disposed proximate the cutting path and the trailing end is disposed distal the cutting path;

wherein the moveable plate is configured to move to selectively adjust the spacing between the leading edge and the cutting path;

wherein the first beveled edge and the fourth beveled edge are configured to cooperate to closely flank the cutting path on opposite sides of the cutting path when the first moveable portion is selectively moved proximate the cutting path, wherein the first beveled edge is substantially parallel to the fourth beveled edge; and wherein the second beveled edge and the third beveled edge are configured to cooperate to closely flank the cutting path on opposite sides of the cutting path when the second moveable portion is selectively moved proximate the cutting path, wherein the second beveled edge is substantially parallel to the third beveled edge.

2. The auxiliary fence of claim 1, wherein the moveable plate is removeably coupled to the fixed plate.

3. The auxiliary fence of claim 1, further comprising a link plate mounted to the fixed plate, the link plate including mounting points to couple a fence extension member.

4. The auxiliary fence of claim 1, wherein:

the saw blade is configured to pivot to define cutting paths oriented at different angles relative to the primary fence; and the moveable plate is configured to move to selectively adjust the spacing between the leading edge and the cutting paths oriented at different angles relative to the primary fence as the saw blade pivots.

5. The auxiliary fence of claim 1, wherein:

the moveable plate defines a first slot extending longitudinally;

the auxiliary fence further comprises a first shaft coupled to the fixed plate and extending through the first slot;

the moveable plate is vertically supported on the first shaft;

the first slot and the shaft cooperate to define how far the moveable plate may selectively move relative to the fixed plate.

6. The auxiliary fence of claim 5, wherein the first shaft is a threaded fastener.

7. The auxiliary fence of claim 5, wherein:

the moveable plate defines a second slot extending longitudinally and longitudinally spaced from the first slot;

the auxiliary fence further comprises a second shaft coupled to the fixed plate and extending through the second slot; and the moveable plate is vertically supported on the second shaft.

8. The auxiliary fence of claim 7, wherein the second slot is substantially identical to the first slot.

9. The auxiliary fence of claim 1, wherein:

the fixed plate defines a first set of guide marks at selected angles;

the moveable plate defines a second set of guide marks at selected angles corresponding to the selected angles of the first set of guide marks; and aligning a selected guide mark from the second set of guide marks with a corresponding guide mark of the first set of guide marks positions the moveable plate at a desired position proximate the cutting path.

10. The auxiliary fence of claim 9, wherein the selected angles correspond to predetermined cutting paths oriented at predetermined angles relative to the primary fence.

11. The auxiliary fence of claim 1, wherein the moveable plate is configured to closely flank the cutting path on opposite sides of the cutting path by the first beveled edge and the second beveled edge when the first moveable portion is selectively moved proximate the cutting path and the second moveable portion is selectively moved proximate the cutting path.

12. The auxiliary fence of claim 11, wherein the close flanking position of the moveable plate is selected to reduce the gap between the first beveled edge and the second beveled edge through which the saw blade extends along the cutting path sufficient to block workpiece fragments ejected by the saw blade when cutting the workpiece.

13. The auxiliary fence of claim 11, wherein:

the saw blade is configured to pivot to define cutting paths oriented at different angles relative to the primary fence; and the moveable plate is configured to closely flank the cutting paths oriented at different angles relative to the primary fence as the saw blade pivots by positioning the first beveled edge and the second beveled edge proximate to the cutting paths.

14. The auxiliary fence of claim 1, wherein the fixed plate is composed of a phenolic sheet material.

15. The auxiliary fence of claim 14, wherein the moveable plate is composed of a phenolic sheet material.

16. The auxiliary fence of claim 1, wherein the primary fence has a fixed width.

17. The auxiliary fence of claim 1, wherein the moveable plate is configured to selectively move to minimize the spacing between the leading edge and the cutting path for the moveable plate to block workpiece fragments ejected by the saw blade when cutting the workpiece.

* * * * *